US009618188B2

(12) United States Patent
Hatanaka et al.

(10) Patent No.: US 9,618,188 B2
(45) Date of Patent: Apr. 11, 2017

(54) LIGHT EMITTING DEVICE AND VEHICULAR LIGHTING DEVICE

(71) Applicant: Toshiba Lighting & Technology Corporation, Yokosuka-shi, Kanagawa-ken (JP)

(72) Inventors: Toshihiro Hatanaka, Yokosuka (JP); Ryuji Tsuchiya, Yokosuka (JP); Tomohiro Mizoguchi, Yokosuka (JP); Daisuke Kosugi, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/438,032

(22) PCT Filed: Aug. 23, 2013

(86) PCT No.: PCT/JP2013/072615
§ 371 (c)(1),
(2) Date: Apr. 23, 2015

(87) PCT Pub. No.: WO2014/083897
PCT Pub. Date: Jun. 5, 2014

(65) Prior Publication Data

US 2015/0285470 A1 Oct. 8, 2015

(30) Foreign Application Priority Data

Nov. 29, 2012 (JP) ..... 2012-261434

(51) Int. Cl.
*F21V 15/01* (2006.01)
*F21V 17/10* (2006.01)
(Continued)

(52) U.S. Cl.
CPC ..... *F21V 17/101* (2013.01); *F21S 48/00* (2013.01); *F21S 48/212* (2013.01);
(Continued)

(58) Field of Classification Search
CPC ..... F21V 17/101; F21V 29/74; F21V 29/15; F21S 48/212; F21S 48/215; F21S 48/31;
(Continued)

(56) References Cited

U.S. PATENT DOCUMENTS 8,506,133 B2 8/2013 Tomiyoshi et al.
2003/0071556 A1 4/2003 Itaya et al.
(Continued)

FOREIGN PATENT DOCUMENTS

DE 102010029515 A1 12/2011
EP 1995513 A1 11/2008
(Continued)

OTHER PUBLICATIONS

Jun. 11, 2015—(WO) International Prelim Report on Patentability—App PCT/JP2013/072615, Eng Tran.
(Continued)

*Primary Examiner* — Anh Mai
*Assistant Examiner* — Hana Featherly
(74) *Attorney, Agent, or Firm* — Banner & Witcoff, Ltd.

(57) ABSTRACT

A light emitting device according to an embodiment includes: a main body section; a light emitting section provided in the main body section and including a light emitting element; a cover provided on a side of the main body section where the light emitting section is provided; and an adhesive section provided between the main body section and the cover in a part of a region on the side of the main body section where the light emitting section is provided.

7 Claims, 14 Drawing Sheets

(51) Int. Cl.

| | |
|---|---|
| ***F21S 8/10*** | (2006.01) |
| ***F21V 29/74*** | (2015.01) |
| ***F21V 29/15*** | (2015.01) |
| *F21Y 101/00* | (2016.01) |

(52) U.S. Cl.
CPC ..... *F21S 48/215* (2013.01); *F21S 48/255* (2013.01); *F21S 48/31* (2013.01); *F21S 48/328* (2013.01); *F21V 29/15* (2015.01); *F21V 29/74* (2015.01); *F21Y 2101/00* (2013.01)

(58) Field of Classification Search
CPC ..... F21S 48/328; F21S 48/00; F21S 48/255; F21Y 2101/00
USPC ..... 362/546
See application file for complete search history.

(56) References Cited

U.S. PATENT DOCUMENTS

| | | | | |
|---|---|---|---|---|
| 2006/0002125 | A1 | 1/2006 | Kim et al. | |
| 2009/0025202 | A1 | 1/2009 | Ferling et al. | |
| 2011/0175529 | A1 | 7/2011 | Hayashi et al. | |
| 2011/0292653 | A1 | 12/2011 | Hofmann et al. | |
| 2012/0127733 | A1 | 5/2012 | Tomiyoshi et al. | |
| 2012/0127741 | A1* | 5/2012 | Osada | F21K 9/30 362/373 |
| 2013/0188333 | A1 | 7/2013 | Ooya et al. | |
| 2013/0314928 | A1 | 11/2013 | Bittmann et al. | |

FOREIGN PATENT DOCUMENTS

| | | | |
|---|---|---|---|
| JP | 3151914 | U | 6/2009 |
| JP | 2010-071348 | A | 4/2010 |
| JP | 2011-070972 | | 4/2011 |
| JP | 2011-171276 | A | 9/2011 |
| WO | 2011/001605 | A1 | 1/2011 |
| WO | 2012/035729 | A1 | 3/2012 |
| WO | 2012/107298 | | 8/2012 |

OTHER PUBLICATIONS

Oct. 29, 2013—International Search Report—Intl App PCT/JP2013/072615.
Jun. 17, 2016—(EP) Extended Search Report—App 13858672.2.

* cited by examiner

LIGHT EMITTING DEVICE AND VEHICULAR LIGHTING DEVICE

TECHNICAL FIELD

Embodiments described below generally relate to a light emitting device and a vehicular lighting device.

BACKGROUND ART

There is a light emitting device including a light emitting section including a light emitting element such as a light emitting diode (LED), a main body section in which the light emitting section is provided, and a cover fixed to the main body section to cover the light emitting section.

In such a light emitting device, a groove extending over the entire circumference is provided in the vicinity of the outer edge of the main body section. The cover is bonded to the main body section by an adhesive filled in the inside of the groove.

However, in the vicinity of the outer edge of the main body section, thermal stress due to lighting or extinction of the light emitting section increases. If an adhesive section extending over the entire circumference of the main body section is provided, a place where the thermal stress is released cannot be provided.

Therefore, it is likely that the cover easily peels from the main body section.

CITATION LIST

Patent Literature

PTL 1: JP-A-2010-71348

SUMMARY OF INVENTION

Technical Problem

A problem to be solved by the present invention is to provide a light emitting device and a vehicular lighting device that can suppress peeling of a cover from a main body section.

Solution to Problem

A light emitting device according to an embodiment includes: a main body section; a light emitting section provided in the main body section and including a light emitting element; a cover provided on a side of the main body section where the light emitting section is provided; and an adhesive section provided between the main body section and the cover in a part of a region on the side of the main body section where the light emitting section is provided.

Advantageous Effect of Invention

According to the embodiment of the present invention, it is possible to provide a light emitting device and a vehicular lighting device that can suppress peeling of a cover from a main body section.

DESCRIPTION OF EMBODIMENTS

Figure 1:
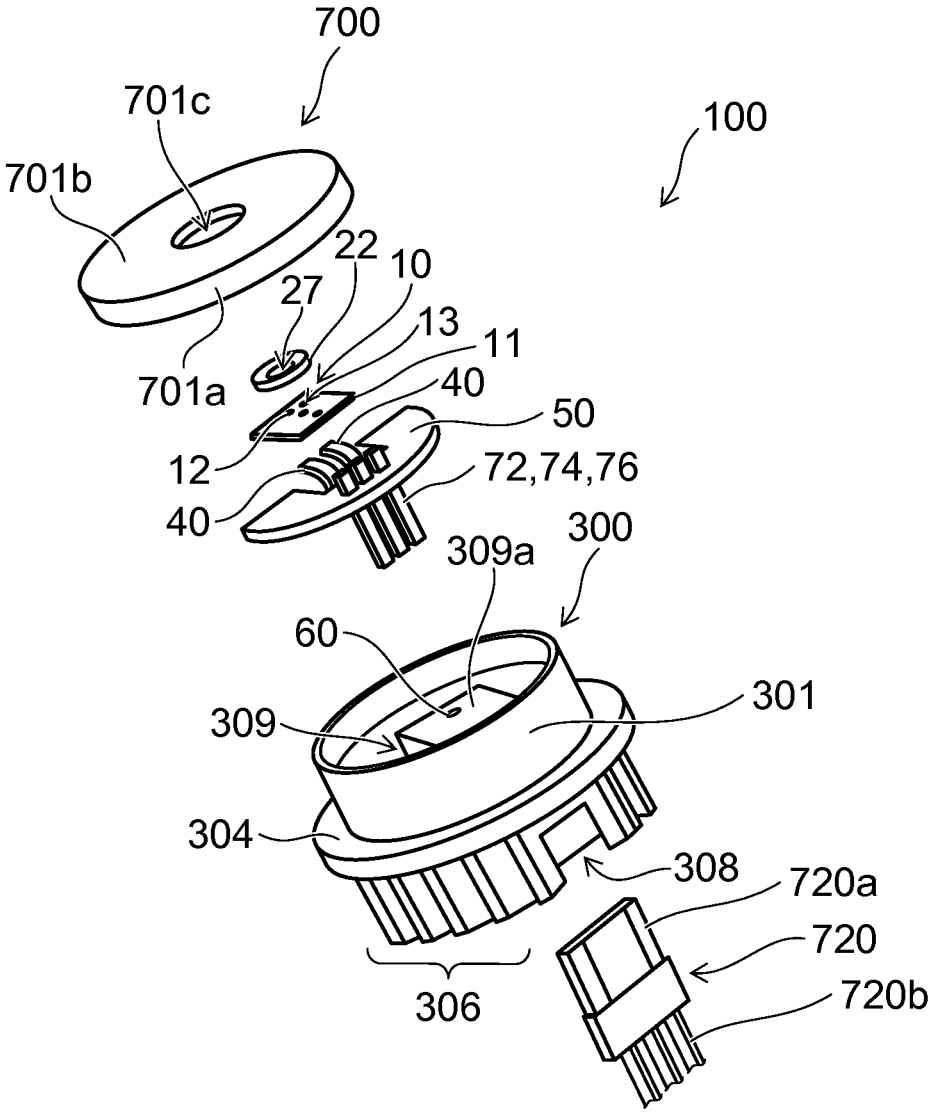
FIG. 1 is a schematic diagram for illustrating a light emitting device 100 according to a first embodiment.

A first invention is a light emitting device including: a main body section; a light emitting section provided in the main body section and including a light emitting element; a cover provided on a side of the main body section where the light emitting section is provided; and an adhesive section provided between the main body section and the cover in a part of a region on the side of the main body section where the light emitting section is provided.

With this light emitting device, it is possible to suppress peeling of the cover from the main body section.

A second invention is the light emitting device in the first invention, wherein, when a maximum distance from the center of the light emitting device to the outer edge of the adhesive section is represented as "a" and a distance from the center of the light emitting device to the outer edge of the cover is represented as "b", the following expression is satisfied:

$$a \leq 0.7b$$

With this light emitting device, it is possible to further suppress the peeling of the cover from the main body section.

A third invention is the light emitting device in the first invention, wherein a plurality of the adhesive sections are provided.

With this light emitting device, it is possible to increase bonding strength.

A fourth invention is the light emitting device in the first invention, further including a recessed section provided at least in any one of the main body section and the cover, wherein the adhesive section is provided at least in the recessed section.

With this light emitting device, it is possible to increase the bonding strength.

A fifth invention is the light emitting device in the first invention, further including: a recessed section provided at least in one of the main body section and the cover; and a projected section provided in the other of the main body section and the cover and inserted into the recessed section.

With this light emitting device, it is possible to increase the bonding strength.

A sixth invention is the light emitting device in the fifth invention, wherein the adhesive section is provided apart from a surface of the main body section on which the light emitting section is provided.

With this light emitting device, it is possible to increase the distance between the adhesive section and a heat source (a light emitting element). Therefore, since the influence of heat on the adhesive section (thermal deterioration) can be suppressed, it is possible to maintain the bonding strength for a long time.

A seventh invention is the light emitting device in the first invention, wherein the main body section further includes a fin.

With this light emitting device, since heat can be efficiently emitted, the influence of heat on the adhesive section (thermal deterioration) can be suppressed. Therefore, it is possible to maintain the bonding strength for a long time.

An eighth invention is a vehicular lighting device including the light emitting device in the first invention.

With this vehicular lighting device, even when lighting and extinction are repeatedly performed, it is possible to suppress peeling of the cover from the main body for a long time.

Embodiments are illustrated below with reference to the drawings. Note that, in the drawings, the same components are denoted by the same reference numerals and signs and detailed explanation of the components is omitted as appropriate.

First Embodiment

Figure 2A:
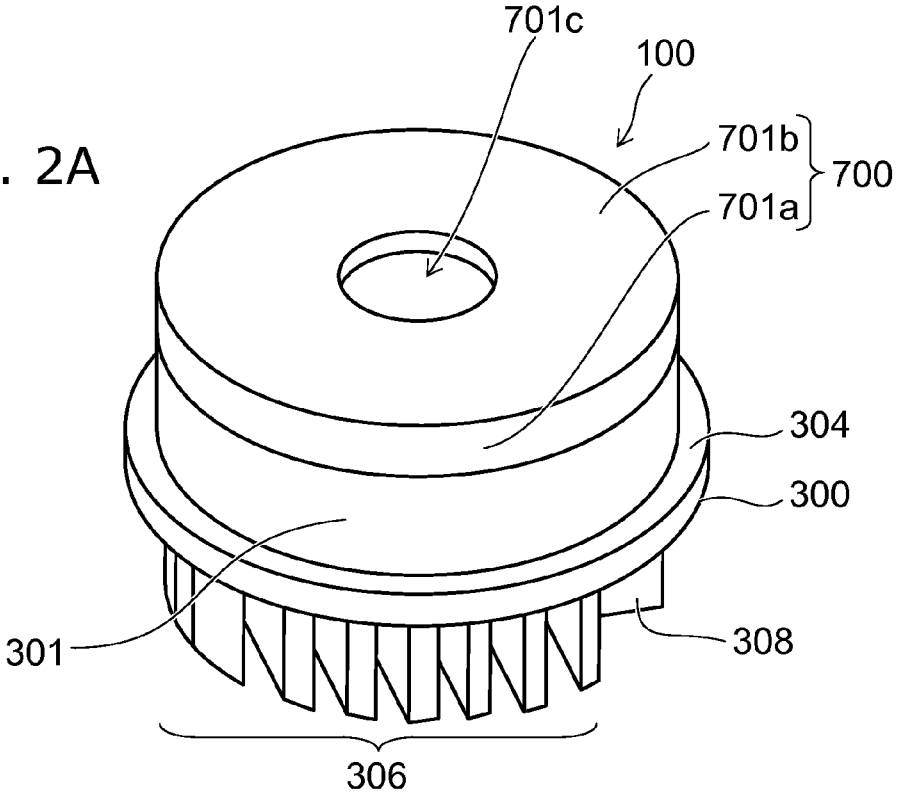
FIGS. 2(*a*) and 2(*b*) are schematic diagrams for illustrating the light emitting device 100 according to the first embodiment.
Figure 2B:
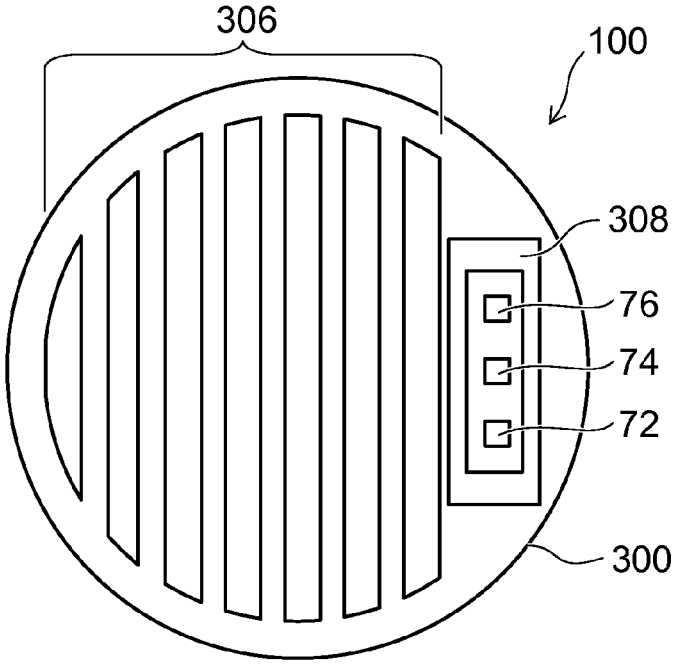

FIGS. 1 and 2 are schematic diagrams for illustrating a light emitting device 100 according to a first embodiment.

Note that FIG. 1 is a schematic exploded view of the light emitting device 100, FIG. 2(*a*) is a schematic perspective view of the light emitting device 100 viewed from the front side, and FIG. 2(*b*) is a schematic diagram of the light emitting device 100 viewed from the rear side.

As shown in FIG. 1 and FIGS. 2(*a*) and 2(*b*), in the light emitting device 100, a main body section 300, a light emitting section 10, a power feed section 50, connecting sections 40, a reflector 22, a cover 700, and an adhesive section 60 are provided.

In the main body section 300, a housing section 301, a flange section 304, fins 306, a socket 308, and an attaching section 309 are provided.

The housing section 301 assumes a cylindrical shape and is provided to project from one surface of the flange section 304. On the inside of the housing section 301, the power feed section 50, the light emitting section 10, and the reflector 22 are housed.

The flange section 304 assumes a disk shape. The housing section 301 is provided on one surface. The fins 306 are provided on the other surface.

A plurality of the fins 306 are provided to project from the surface of the flange section 304. The plurality of fins 306 assume a tabular shape and function as heat radiation fins.

The socket 308 is provided on a side of the flange section 304 where the fins 306 are provided. A connector 720 explained below is inserted into the socket 308.

The attaching section 309 is provided on the inside of the housing section 301. The light emitting section 10 is attached to a surface 309*a* of the attaching section 309.

The main body section 300 has a function of housing the power feed section 50, the light emitting section 10, the reflector 22, and the like and a function of emitting heat generated in the light emitting section 10 and the power feed section 50 to the outside of the light emitting device 100.

In this case, taking into account the emission of the heat to the outside, the main body section 300 can be formed from a material having high thermal conductivity. For example, the main body section 300 can be formed from aluminum, an aluminum alloy, heat conduction resin, and the like.

Portions such as the fins 306 that emit heat to the outside can be formed from a material having high thermal conductivity. The other portions can be formed from resin or the like.

In the light emitting section 10, a substrate 11, light emitting elements 12, a resistor 13, a not-shown wiring pattern, and the like are provided.

The substrate 11 assumes a tabular shape. The not-shown wiring pattern is provided on the surface of the substrate 11. The material and the structure of the substrate 11 are not particularly limited. For example, the substrate 11 can be formed from inorganic materials (ceramics) such as aluminum oxide and aluminum nitride, organic materials such as paper phenol and glass epoxy, and the like. The substrate 11 may be a substrate obtained by coating the surface of a metal plate with an insulator. Note that, when the surface of the metal plate is coated with the insulator, the insulator may be an insulator made of an organic material or may be an insulator made of an inorganic material.

When a heat value of the light emitting elements 12 is large, it is preferable to form the substrate 11 using a material having high thermal conductivity from the viewpoint of heat radiation. As the material having high thermal conductivity, for example, ceramics such as aluminum oxide and aluminum nitride, high heat conduction resin, and a metal plate with the surface coated with an insulator can be illustrated. The substrate 11 may be a single layer or a multilayer.

The light emitting elements 12 are provided on the substrate 11 and electrically connected to the not-shown wiring pattern. In this case, the light emitting elements 12 can be mounted on the wiring pattern.

A mounting method for the light emitting elements 12 is not particularly limited. For example, the light emitting elements 12 may be flip-chip mounted, may be mounted using a wire bonding method, or may be solder-joined.

The light emitting elements 12 can be, for example, self-emitting devices such as a light emitting diode, an organic light emitting diode, and a laser diode.

Irradiation surfaces of the light emitting elements 12 are directed to the front side of the light emitting section 10 and mainly irradiate light toward the front side of the light emitting section 10.

The number, the arrangement, and the like of the light emitting elements 12 are not limited to illustrated ones and can be changed as appropriate according to the size, the use, and the like of the light emitting device 100.

The resistor 13 is provided on the substrate 11 and electrically connected to the not-shown wiring pattern.

The resistor 13 limits an electric current flowing to the light emitting elements 12. That is, the resistor 13 is provided to protect the light emitting elements 12. The resistor 13 may be, for example, a resistor of a surface mounting type, may be a printed resistor formed on the substrate 11 using a printing method or the like, or may be a resistor including a lead wire.

The not-shown wiring pattern is provided at least on one surface of the substrate 11.

Wiring patterns can also be provided on both the surfaces of the substrate 11. However, in order to reduce manufacturing costs, it is preferable to provide the wiring pattern on one surface of the substrate 11.

An input terminal is provided in the wiring pattern. The connecting sections 40 are electrically connected to the input terminal. Therefore, the light emitting elements 12 and the resistor 13 are electrically connected to the power feed section 50 via the wiring pattern and the connecting sections 40.

The power feed section 50 is housed on the inside of the housing section 301.

In the power feed section 50, power feed terminals 72, 74, and 76 are provided. The power feed terminals 72, 74, and 76 project from a surface of the power feed section 50 on the main body section 300 side. The power feed terminals 72, 74, and 76 extend on the inside of the socket 308 and are exposed to the inside of the socket 308.

On the surface of the power feed section 50, a wiring pattern electrically connected to the power feed terminals 72, 74, and 76 is provided. Circuit components such as a capacitor and a resistor may be mounted on the wiring pattern.

Note that the power feed terminals 72, 74, and 76 are not limited to the illustrated ones. For example, the number, the arrangement, the form, and the like of the power feed terminals can be changed as appropriate.

A plurality of the connecting sections 40 are provided. The connecting sections 40 electrically connect the wiring pattern provided in the power feed section 50 and the wiring pattern provided in the light emitting section 10. The connecting sections 40 can be connecting sections made of, for example, a wire, a ribbon, or a strap of metal. The material of the connecting sections 40 is not particularly limited as long as the material is a conductive material. The material of the connecting sections 40 can be, for example, phosphor bronze. Alternatively, soldered portions by soldering can be formed as the connecting sections 40. An example is shown in which the power feed section 50 and the light emitting section 10 are divided. However, a configuration can also be adopted in which the power feed section 50 and the light emitting section 10 are integrally formed and the connecting sections 40 are omitted.

The reflector 22 is provided to surround the light emitting elements 12. The reflector 22 assumes, for example, an annular shape such that the plurality of light emitting elements 12 are exposed in a center section 27.

The reflector 22 can be a reflector made of, for example, resin or ceramics. A wall surface on the center section 27 side of the reflector 22 is formed as a slope. A part of lights irradiated from the light emitting elements 12 is reflected on the wall surface on the center section 27 side of the reflector 22 and irradiated toward the front side of the light emitting section 10. Note that the form of the reflector 22 is not limited to the illustrated one and can be changed as appropriate.

Resin can be filled in the center section 27 of the reflector 22. As the resin filled in the center section 27 of the reflector 22, for example, silicone resin can be illustrated. If the resin is filled in the center section 27 of the reflector 22, it is possible to suppress mechanical contact with the light emitting elements 12 and the like from the outside and adhesion of the air, moisture, and the like to the light emitting elements 12 and the like. Therefore, it is possible to improve reliability for the light emitting section 10.

A phosphor can be contained in the resin filled in the center section 27 of the reflector 22. The phosphor can be, for example, a YAG phosphor (yttrium aluminum garnet-based phosphor). For example, when the light emitting elements 12 are blue light emitting diodes and the phosphor is the YAG phosphor, the YAG phosphor is excited by blue light emitted from the light emitting elements 12. Yellow fluorescent light is radiated from the YAG phosphor. The blue light and the yellow light are mixed, whereby white light is irradiated from the light emitting section 10. Note that the type of the phosphor and the type of the light emitting elements 12 are not limited to the illustrated ones and can be changed as appropriate such that a desired emitted light color is obtained according to the use and the like of the light emitting device 100.

The cover 700 is provided on a side of the main body section 300 where the light emitting section 10 is provided.

In the cover 700, a cylinder section 701*a* and an end face section 701*b* are provided.

The cylinder section 701*a* assumes a cylindrical shape.

The end face section 701*b* is provided at an end portion of the cylinder section 701*a* on the opposite side of the main body section 300 side. The end face section 701*b* assumes a tabular shape and has an irradiation hole 701*c* in the center. The irradiation hole 701*c* pierces through the end face section 701*b* in the thickness direction. Light irradiated from the light emitting section 10 is irradiated to the outside via the irradiation hole 701*c*.

The material of the cover 700 is not particularly limited. The cover 700 can be formed from, for example, resin and metal.

A connector 720 can be used for electric connection of the light emitting device 100 and a not-shown power supply.

In the connector 720, a main body section 720*a*, wires 720*b*, and a not-shown plurality of terminals are provided.

The main body section 720*a* is formed from an insulative material such as resin and includes the not-shown plurality of terminals on the inside.

A plurality of the wires 720*b* are respectively electrically connected to the not-shown plurality of terminals provided on the inside of the main body section 720*a*. When the main body section 720*a* is inserted into the socket 308, the not-shown plurality of terminals provided on the inside of the main body section 720*a* and the power feed terminals 72, 74, and 76 are respectively electrically connected.

The not-shown power supply is electrically connected to the plurality of wires 720*b*.

The adhesive section 60 is provided between the main body section 300 and the cover 700. In this embodiment, the adhesive section 60 is provided between the surface 309*a* of the attaching section 309 and the end face section 701*b* of the cover 700. The adhesive section 60 is provided in a part of a region of the surface 309*a* on the side of the main body section 300 where the light emitting section 10 is provided.

The cover 700 is fixed (bonded) to the main body section 300 via the adhesive section 60.

Figure 3A:
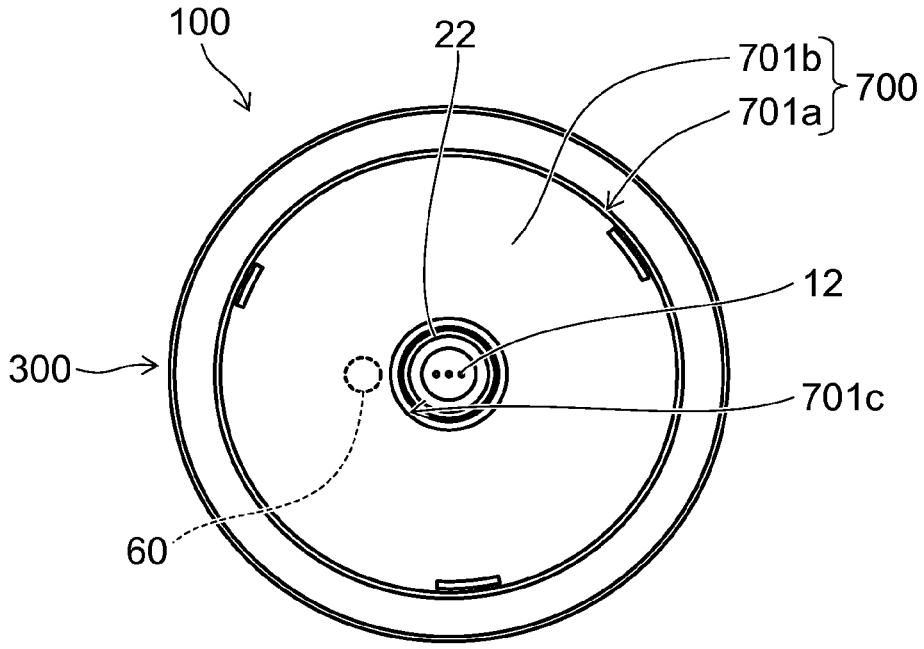
FIGS. 3(*a*) and 3(*b*) are schematic diagrams for illustrating an adhesive section 60.
Figure 3B:
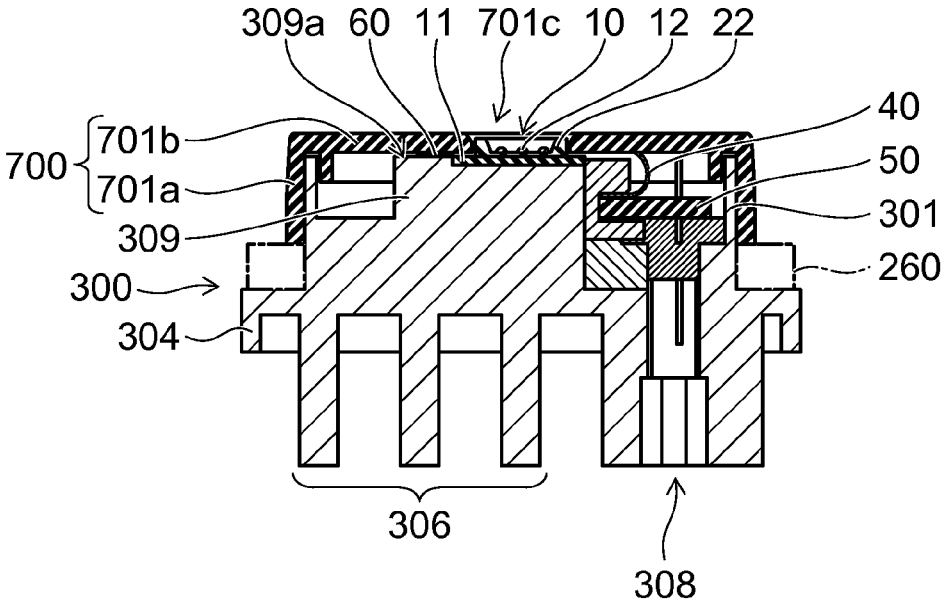

FIG. 3 is a schematic diagram for illustrating the adhesive section 60.

Note that FIG. 3(*a*) is a schematic diagram of the light emitting device 100 viewed from the front side and FIG. 3(*b*) is a schematic sectional view of the light emitting device 100.

Figure 4:
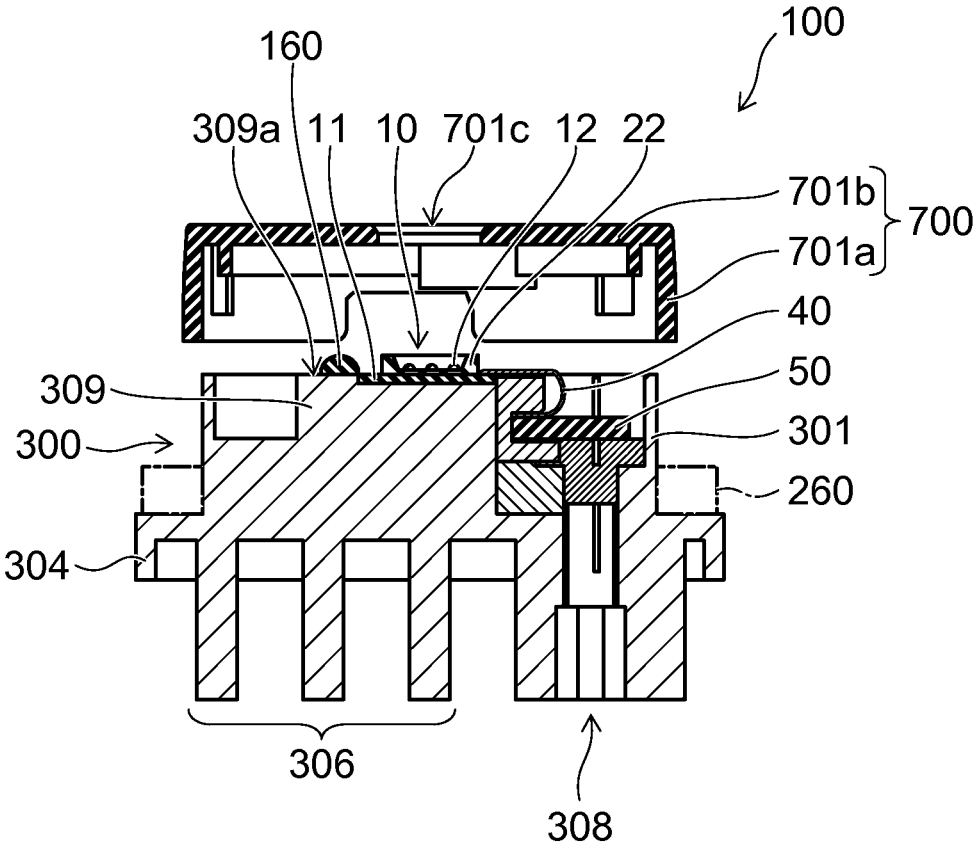
FIG. 4 is a schematic diagram for illustrating formation of the adhesive section 60.

FIG. 4 is a schematic diagram for illustrating formation of the adhesive section 60.

As shown in FIGS. 3(*a*) and 3(*b*), the adhesive section 60 is provided between the surface 309*a* of the attaching section 309 and the end face 701*b* of the cover 700.

Such an adhesive section 60 can be formed as explained below.

As shown in FIG. 4, first, an adhesive 160 is applied to a predetermined position of the surface 309*a* of the attaching section 309. The adhesive 160 can be applied in a droplet shape using a liquid dispensing apparatus such as a dispenser or can be applied in a planar shape.

An application amount of the adhesive 160 is not particularly limited. However, if the application amount of the adhesive 160 is too large, it is likely that a reducing effect for thermal stress explained below decreases. If the application amount of the adhesive 160 is too small, it is likely that bonding strength excessively decreases.

The application amount of the adhesive 160 can be set to, for example, an amount at which an adhesion area in the adhesive section 60 is about 9 $mm^2$. However, the application amount of the adhesive is not limited to this and can be changed as appropriate according to the size and the use (an environment of use) of the light emitting device 100.

The type of the adhesive 160 is not particularly limited. The adhesive 160 can be, for example, an epoxy-based adhesive. However, the type of the adhesive 160 is not limited to this and can be changed as appropriate according to, for example, the materials of the main body section 300 and the cover 700.

Subsequently, the cover 700 is attached to be put over the housing section 301 of the main body section 300. Then, the applied adhesive 160 is crushed into a film shape.

Thereafter, the adhesive section 60 is formed by hardening the adhesive 160. The cover 700 is fixed to the main body section 300 via the adhesive section 60.

The hardening of the adhesive 160 may be performed at, for example, the room temperature or may be performed by heating the adhesive 160 to a predetermined temperature. However, a hardening method for the adhesive 160 is not limited to this and can be changed as appropriate according to the type and the like of the adhesive 160.

Next, action and effects of the adhesive section 60 are illustrated.

Figure 5A:
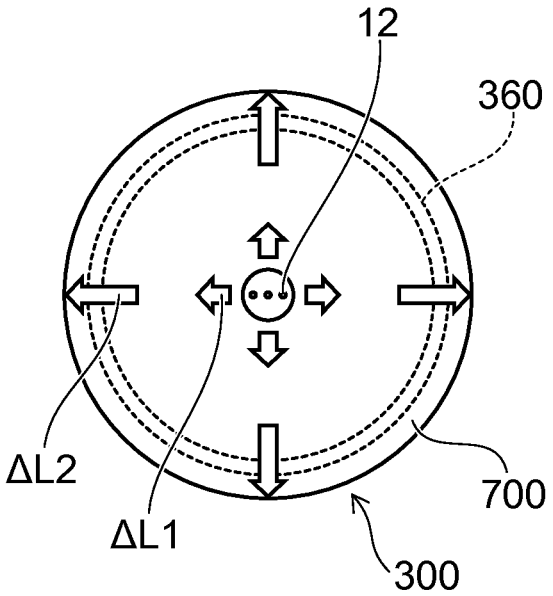
FIGS. 5(*a*) and 5(*b*) are schematic diagrams for illustrating action and effects of an adhesive section 360 according to a comparative example.
Figure 5B:
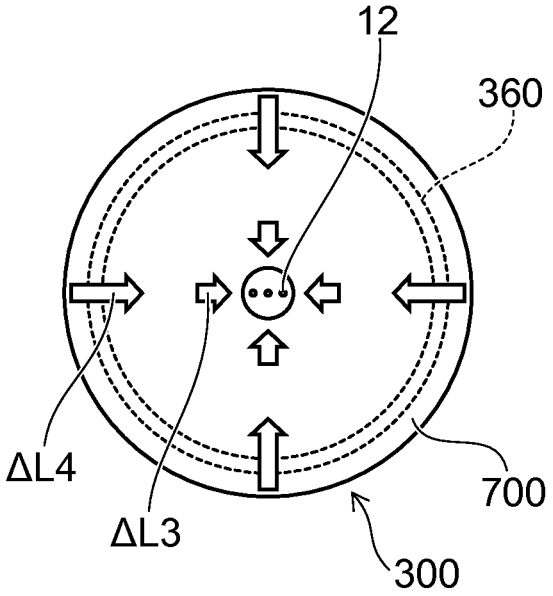

FIG. 5 is a schematic diagram for illustrating action and effects of an adhesive section 360 according to a comparative example.

Note that FIG. 5(*a*) is a schematic diagram for illustrating a state during lighting of the light emitting elements 12 and FIG. 5(*b*) is a schematic diagram for illustrating a state during extinction of the light emitting elements 12.

As shown in FIGS. 5(*a*) and 5(*b*), the adhesive section 360 according to the comparative example assumes a ring shape in the external view and is provided over the entire circumference in the vicinity of the outer edge of a light emitting device (a main body section).

During the lighting of the light emitting elements 12, the main body section 300 and the cover 700 are heated by heat from the light-emitting elements 12.

During the extinction of the light emitting elements 12, the heated main body section 300 and the heated cover 700 are cooled by heat radiation.

In this case, as shown in FIG. 5(*a*), as a dimension change amount due to the heating, a dimension change amount ΔL2 on the outer edge side of the light emitting device is larger than a dimension change amount ΔL1 on the center side of the light emitting device.

As shown in FIG. 5(*b*), as a dimension change amount due to the cooling, a dimension change amount ΔL4 on the outer edge side of the light emitting device is larger than a dimension change amount ΔL3 on the center side of the light emitting device.

Thermal stress occurs according to a difference between the coefficient of thermal expansion of the material of the main body section 300 and the coefficient of thermal expansion of the material of the cover 700.

In this case, since the dimension change amounts ΔL2 and ΔL4 on the outer edge side of the light emitting device are larger than the dimension change amounts ΔL1 and ΔL3 on the center side of the light emitting device, the thermal stress on the outer edge side of the light emitting device is larger than the thermal stress on the center side.

Therefore, it is likely that an excessive load is applied to the adhesive section 360 provided in the vicinity of the outer edge of the light emitting device.

The adhesive section 360 assumes a ring shape in the external appearance and is provided over the entire circumference in the vicinity of the outer edge of the light emitting device. Therefore, a place where the thermal stress is released cannot be provided.

Therefore, the dimension change amount due to the thermal expansion needs to be absorbed by only the adhesive section 360.

Consequently, if the adhesive section 360 according to the comparative example is provided, it is likely that the cover 700 easily peels from the main body section 300.

In this case, if the area of the adhesive section 360 (the application area of the adhesive) is increased, the cover 700 less easily peels from the main body section 300. However, it is likely that new problems occur in that the light emitting device 100 is increased in size and costs increases because an amount of the adhesive 160 increases.

Figure 6A:
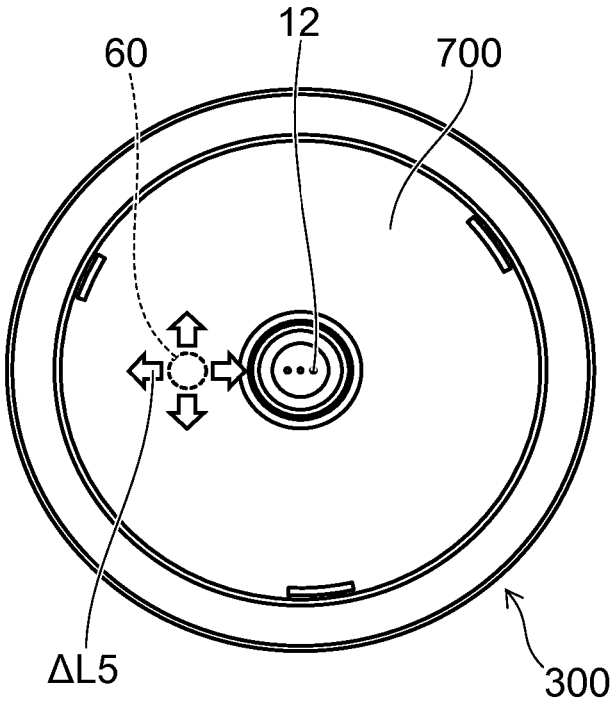
FIGS. 6(*a*) and 6(*b*) are schematic diagrams for illustrating action and effects of the adhesive section 60.
Figure 6B:
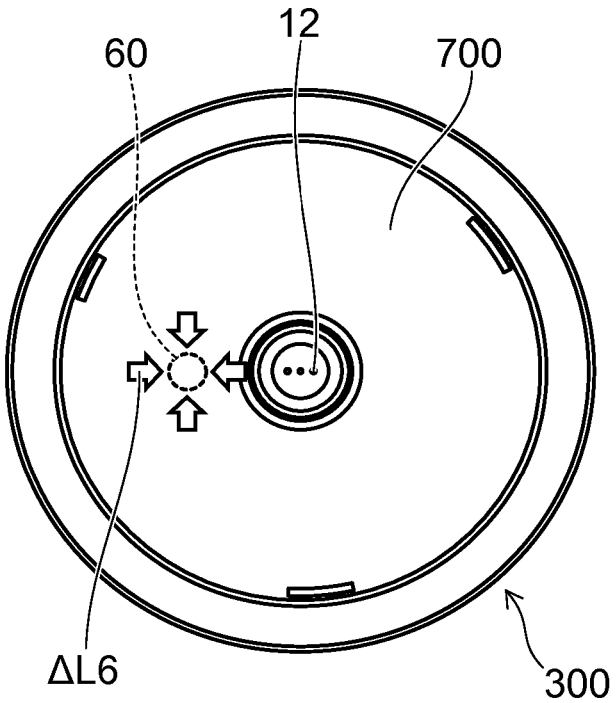

FIG. 6 is a schematic diagram for illustrating the action and effects of the adhesive section 60 according to this embodiment.

Note that FIG. 6(*a*) is a schematic diagram for illustrating a state during lighting of the light emitting elements 12 and FIG. 6(*b*) is a schematic diagram for illustrating a state during extinction of the light emitting elements 12.

As shown in FIGS. 6(*a*) and 6(*b*), the adhesive section 60 according to this embodiment is provided on the center side of the light emitting device 100.

Therefore, as shown in FIG. 6(*a*), the dimension change amount ΔL5 due to the heating can be reduced.

As shown in FIG. 6(*b*), the dimension change amount ΔL6 due to the cooling can also be reduced.

As a result, the thermal stress applied to the adhesive section 60 can be reduced. Therefore, it is possible to maintain the bonding strength in the adhesive section 60 for a long time.

As shown in FIGS. 6(*a*) and 6(*b*), the adhesive section 60 is provided in a part of a region of the surface 309*a* of the attaching section 309.

Therefore, it is possible to release the thermal stress in a region where the adhesive section 60 is not provided.

Figure 7A:
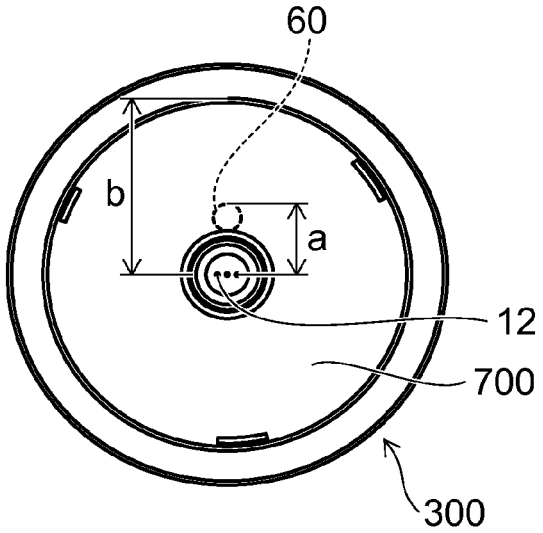
FIGS. 7(*a*) to 7(*c*) are schematic diagrams for illustrating a relation between a disposing position of the adhesive section and peeling.
Figure 7B:
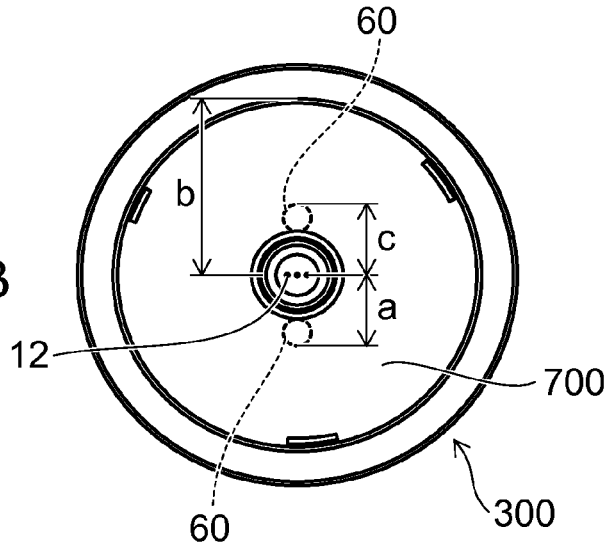
Figure 7C:
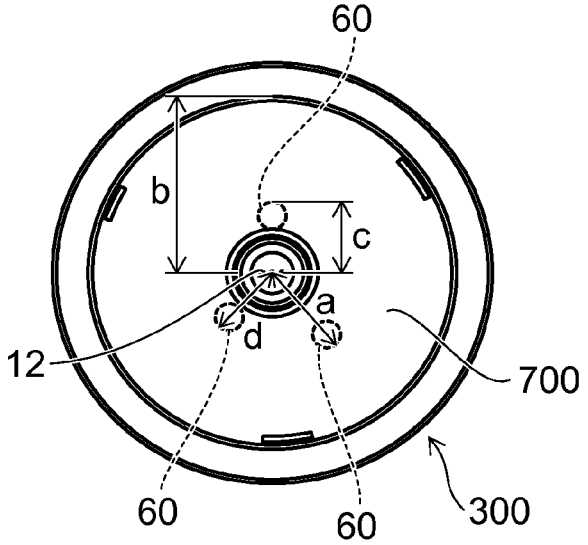

FIG. 7 is a schematic diagram for illustrating a relation between a disposing position of the adhesive section and peeling.

Note that, in FIG. 7(*a*), the number of adhesive sections is one, in FIG. 7(*b*), the number of adhesive sections is two, and, in FIG. 7(*c*), the number of adhesive sections is three.

In the figure, "a", "c", and "d" are maximum distances from the center of the light emitting device to the outer edge of the adhesive section 60. Note that "a" is larger than "c" and "d".

In the figure, "b" is a distance from the center of the light emitting device to the outer edge of the cover 700.

Table 1 is a table for representing the relation between the disposing position of the adhesive section and the peeling.

Table 1 is a result obtained by carrying out a temperature cycle test and visually observing a bonded state of the main body section 300 and the cover 700.

In the temperature cycle test, the main body section 300 and the cover 700 were left untouched for 30 minutes at −40° C. and left untouched for 30 minutes at 85° C. in one cycle. After the temperature cycle test was repeated 1000 cycles, a bonded state was visually observed.

○ in Table 1 indicates that peeling did not occur. x indicates that peeling occurred.

When a plurality of the adhesive sections 60 were provided, the adhesive section 60 provided in a position "a" most distant from the center of the light emitting device was set as an evaluation target.

TABLE 1

| | | Material of the main body section 300 | |
|---|---|---|---|
| | | Resin | Metal |
| | | Material of the cover 700 | |
| | | Resin | Resin |
| a/b | 0.1 | ○ | ○ |
| | 0.3 | ○ | ○ |
| | 0.5 | ○ | ○ |
| | 0.6 | ○ | ○ |
| | 0.7 | ○ | X |
| | 0.8 | X | X |
| | 0.9 | X | X |

As it is seen from Table 1, if a relation between "a" and "b" is set as a≤0.7b, it is possible to suppress the peeling of the cover 700 from the main body section 300.

If the material of the main body section 300 and the material of the cover 700 are different, the thermal stress increases because a difference between the coefficients of thermal expansion increases.

Therefore, as it is seen from Table 1, when the material of the main body section 300 and the material of the cover 700 are different, it is preferable to set the relation between "a" and "b" as a≤0.6b.

Note that it is also confirmed that, if a/b is in this range, peeling does not occur in the cases of "c" and "d" in which thermal stress is smaller.

In the above explanation, the number of the adhesive sections 60 is one to three. The same applies when the number of the adhesive sections 60 is equal to or larger than four. However, if the number of the adhesive sections 60 is excessively increased, it is likely that the region for releasing the thermal stress excessively decreases. Therefore, the number of the adhesive sections 60 can be set as appropriate according to a temperature environment in which the light emitting device is provided, the size of the light emitting device, and the like.

Note that the relation between the disposing position of the adhesive section 60 and the peeling is the same in the case of an adhesive section 61 explained below.

As explained above, if the adhesive section 60 according to this embodiment is provided, it is possible to suppress peeling of the cover 700 from the main body section 300.

Since the area of the adhesive section 60 can be reduced, it is possible to attain a reduction in the size of the light emitting device 100. Since an amount of use of the adhesive 160 in forming the adhesive section 60 can be reduced, it is possible to attain a reduction in manufacturing costs of the light emitting device 100. Since a manufacturing process (a bonding process) for the light emitting device 100 can be simplified, it is possible to attain a reduction in manufacturing costs of the light emitting device 100.

Second Embodiment

Figure 8A:
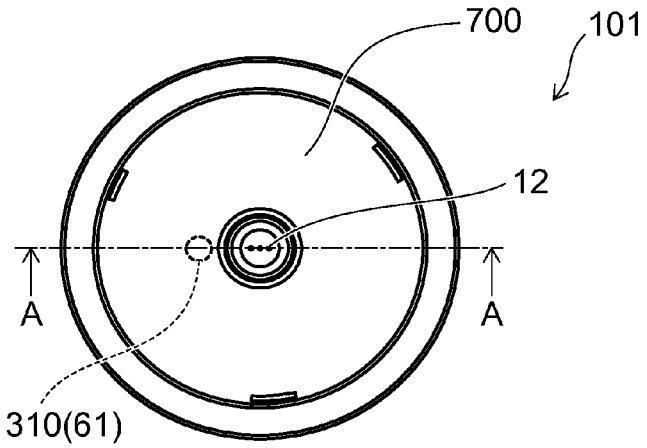
FIGS. 8(*a*) to 8(*c*) are schematic diagrams for illustrating a light emitting device 101 according to a second embodiment.
Figure 8B:
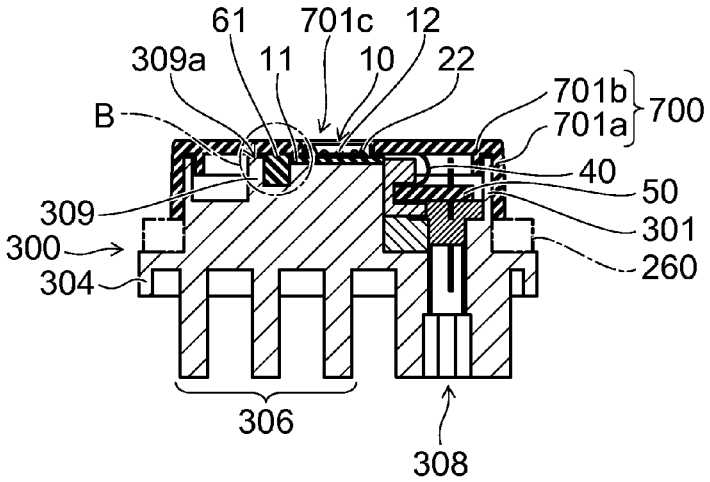
Figure 8C:
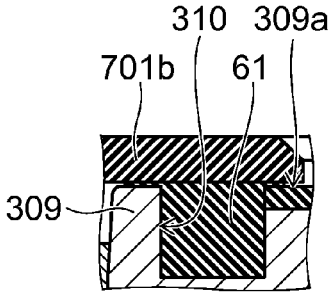

FIG. 8 is a schematic diagram for illustrating a light emitting device 101 according to a second embodiment.

Note that FIG. 8(*a*) is a schematic diagram of the light emitting device 101 viewed from the front side, FIG. 8(*b*) is an A-A line sectional view in FIG. 8(*a*), and FIG. 8(*c*) is a schematic enlarged view of a B part in FIG. 8(*b*).

Figure 9:
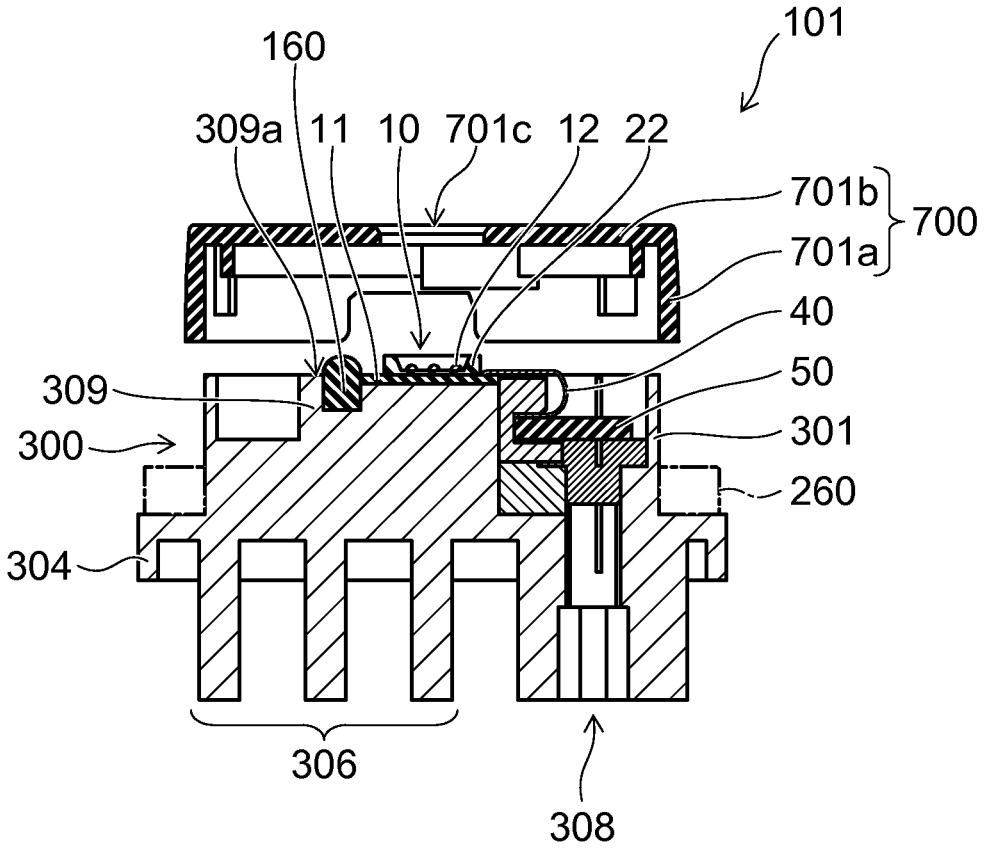
FIG. 9 is a schematic diagram for illustrating formation of an adhesive section 61.

FIG. 9 is a schematic diagram for illustrating formation of an adhesive section 61.

As shown in FIGS. 8(*a*) to 8(*c*), in the light emitting device 101, the main body section 300, the light emitting section 10, the power feed section 50, the connecting sections 40, the reflector 22, the cover 700, and the adhesive section 61 are provided.

A recessed section 310 is opened on the surface 309*a* of the attaching section 309. The opening area and the depth dimension of the recessed section 310 are not particularly limited. However, if the opening area and the depth dimension are set too large, the adhesion area of the adhesive section 61 to be formed excessively increases. Therefore, it is likely that a reducing effect for thermal stress decreases. If the opening area and the depth dimension are set too small, the adhesion area of the adhesive section 61 to be formed excessively decreases. Therefore, it is likely that bonding strength excessively decreases. Therefore, the opening area and the depth dimension of the recessed section 310 can be set as appropriate such that the bonding strength by the adhesive section 61 to be formed is within a proper range.

For example, the opening dimension of the recessed section 310 can be set to about 3 mm×3 mm and the depth dimension of the recessed section 310 can be set to about 3 mm. However, the opening dimension and the depth dimension are not limited to these dimensions.

The recessed section 310 provided in the main body section 300 is illustrated. However, the recessed section 310 can also be provided in the cover 700. That is, the recessed section 310 provided at least in any one of the main body section 300 and the cover 700 only has to be provided. In this case, the adhesive section 61 is provided at least in the recessed section 310.

The adhesive section 61 is provided between the main body section 300 and the cover 700. In this embodiment, the adhesive section 61 is provided between the surface 309*a* of the attaching section 309 and the end face section 701*b* of the cover 700 and between the recessed section 310 and the end face section 701*b* of the cover 700. The cover 700 is fixed (bonded) to the main body section 300 via the adhesive section 61.

Such an adhesive section 61 can be formed as explained below.

As shown in FIG. 9, first, the adhesive 160 is supplied to the inside of the recessed section 310 opened on the surface 309*a* of the attaching section 309. The adhesive 160 can be supplied using a liquid dispensing apparatus such as a dispenser. In this case, the adhesive 160 is supplied until a swelling top of the supplied adhesive 160 reaches above the surface 309*a* of the attaching section 309.

If the position of the swelling top of the supplied adhesive 160 is too high, the adhesion area of the adhesive section 61 to be formed excessively increases. Therefore, it is likely that the reducing effect for thermal stress decreases. If the position of the swelling top of the adhesive 160 is too low, the adhesion area of the adhesive section 61 to be formed excessively decreases. Therefore, it is likely that the strength of the adhesive section 61 excessively decreases.

A supply amount of the adhesive 160 can be set to, for example, an amount at which the adhesion area in the adhesive section 61 is about 9 $mm^2$. However, the supply amount of the adhesive is not limited to this. The supply amount can be changed as appropriate according to, for example, the size of the recessed section 310 and the size and the use (an environment of use) of the light emitting device 101.

Subsequently, the cover 700 is attached to be put over the housing section 301 of the main body section 300. Then, the adhesive 160 present above the surface 309*a* of the attaching section 309 is crushed and enters between the surface 309*a* and the end face section 701*b* of the cover 700.

Thereafter, the adhesive section 61 is formed by hardening the adhesive 160. The cover 700 is fixed to the main body section 300 via the adhesive section 61.

The hardening of the adhesive 160 may be performed at, for example, the room temperature or may be performed by heating the adhesive 160 to a predetermined temperature. However, a hardening method for the adhesive 160 is not limited to this and can be changed as appropriate according to the type and the like of the adhesive 160.

If the adhesive section 61 according to this embodiment is provided, it is possible to enjoy action and effects the same as the action and effects of the adhesive section 60 explained above.

Further, it is possible to stabilize the position of the adhesive section 61 by providing the recessed section 310. It is possible to increase the adhesion area by providing the recessed section 310.

Third Embodiment

Figure 10A:
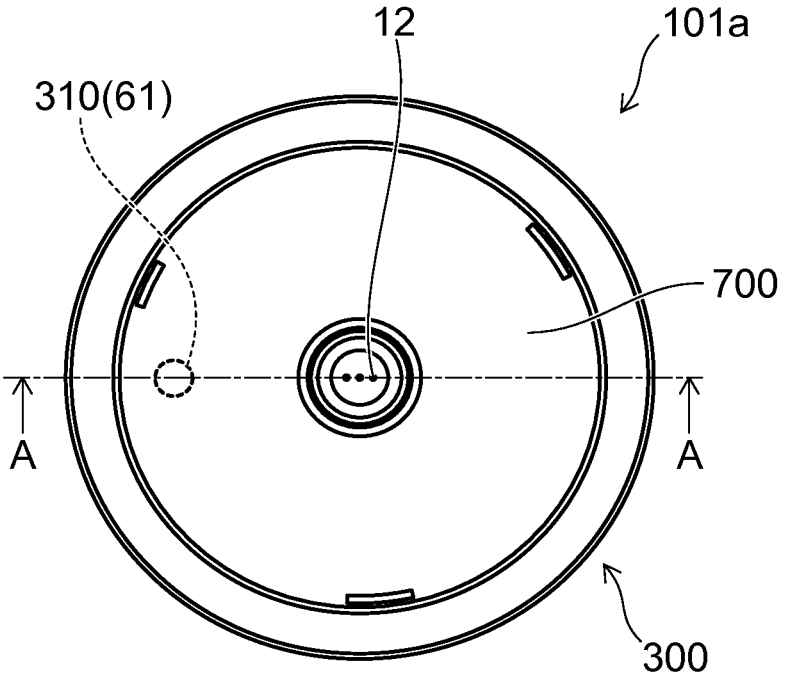
FIGS. 10(*a*) and 10(*b*) are schematic diagrams for illustrating a light emitting device 101*a* according to a third embodiment.
Figure 10B:
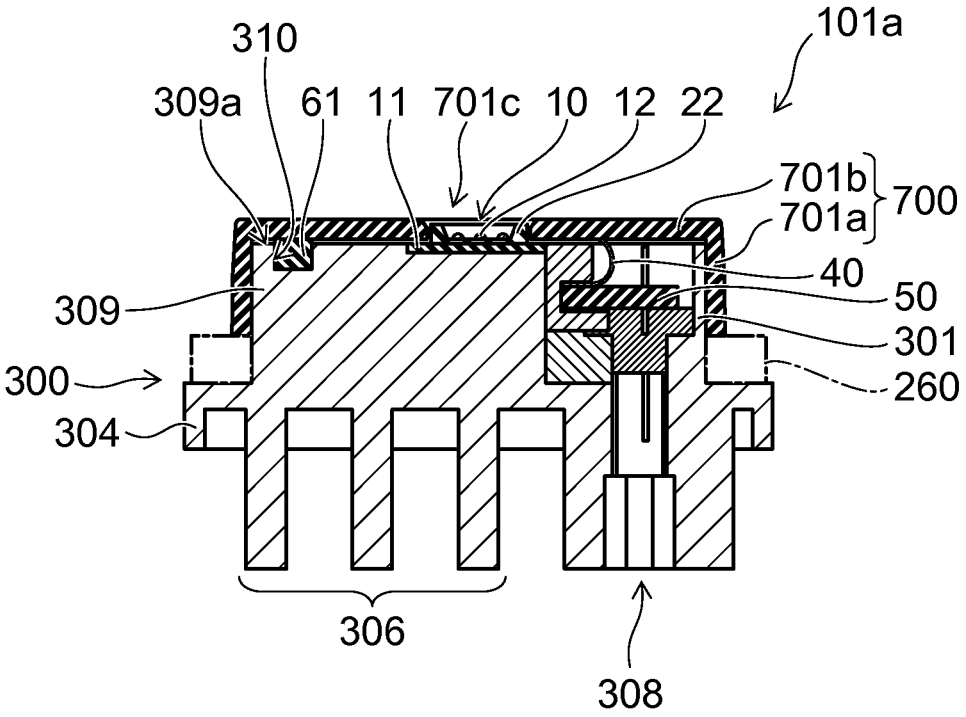

FIG. 10 is a schematic diagram for illustrating a light emitting device 101*a* according to a third embodiment.

Note that FIG. 10(*a*) is a schematic diagram of the light emitting device 101*a* viewed from the front side and FIG. 10(*b*) is an A-A line sectional view in FIG. 10(*a*).

As shown in FIGS. 10(*a*) and 10(*b*), in the light emitting device 101*a*, the main body section 300, the light emitting section 10, the power feed section 50, the connecting sections 40, the reflector 22, the cover 700, and the adhesive section 61 are provided. In the light emitting device 101 illustrated in FIG. 8, the adhesive section 61 is provided on the center side of the light emitting device 101. However, in the light emitting device 101*a* according to this embodiment, the adhesive section 61 is provided on the outer edge side of the light emitting device 101*a*.

As explained above, the thermal stress on the outer edge side of the light emitting device 101*a* is larger than the thermal stress on the center side. Therefore, the thermal stress is large compared with the adhesives section 61 illustrated in FIG. 8. However, the thermal stress can be released in the region where the adhesive section 61 is not provided. Therefore, it is possible to reduce a load on the adhesive section 61 compared with the adhesive section 360 illustrated in FIG. 5.

Therefore, it is possible to suppress the peeling of the cover 700 from the main body section 300 compared with the adhesive section 360 illustrated in FIG. 5.

Further, if the adhesive section 61 is provided on the outer edge side of the light emitting device 101*a*, it is possible to increase the distance between the adhesive section 61 and a heat source (the light emitting elements 12).

Therefore, since the influence of heat on the adhesive section 61 (thermal deterioration) can be suppressed, it is possible to maintain bonding strength for a long time.

Fourth Embodiment

Figure 11A:
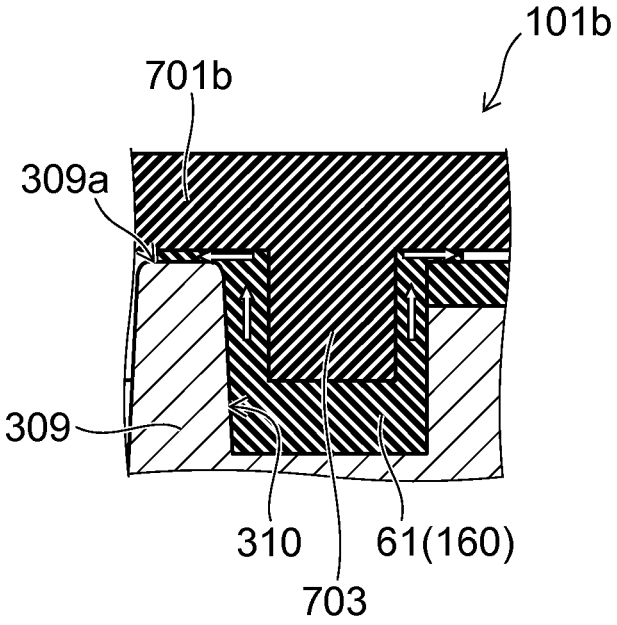
FIGS. 11(*a*) and 11(*b*) are schematic diagrams for illustrating a light emitting device 101*b* according to a fourth embodiment.
Figure 11B:
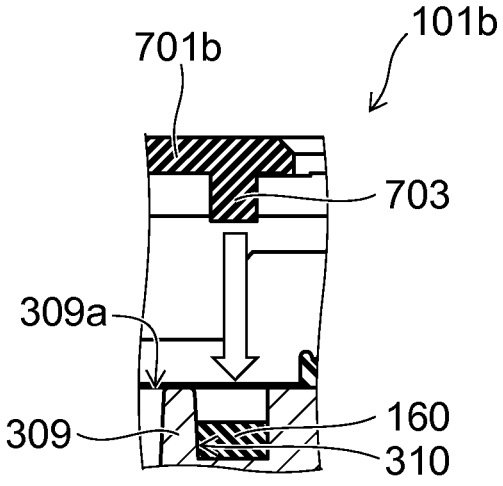

FIG. 11 is a schematic diagram for illustrating a light emitting device 101*b* according to a fourth embodiment.

Note that FIG. 11(*a*) is a schematic sectional view for illustrating the adhesive section 61 in the light emitting device 101*b* and FIG. 11(*b*) is a schematic diagram for illustrating formation of the adhesive section 61.

As shown in FIG. 11(*a*), a projected section 703 is provided in the cover 700 provided in the light emitting device 101*b*. That is, in the light emitting device 101*b*, the projected section 703 is further provided in the light emitting device 101 illustrated in FIG. 8.

The projected section 703 is provided in the end face section 701*b* of the cover 700 and inserted into the inside of the recessed section 310.

Note that the projected section 703 may be provided in the main body section 300. The recessed section 310 may be provided in the cover 700. That is, the recessed section 310 provided in one of the main body section 300 and the cover 700 and the projected section 703 provided in the other of the main body section 300 and the cover 700 and inserted into the recessed section 310 only have to be provided.

Such an adhesive section 61 can be formed as explained below.

As shown in FIG. 11(*b*), first, the adhesive 160 is supplied to the inside of the recessed section 310. The adhesive 160 can be supplied using a liquid dispensing apparatus such as a dispenser. A supply amount of the adhesive 160 is set taking into account an amount flowing out from an opening section of the recessed section 310 when the projected section 703 is inserted into the inside of the recessed section 310.

If the supply amount of the adhesive 160 is too large, since the contact area of the adhesive section 61 to be formed excessively increases, it is likely that a reducing effect for thermal stress decreases. If the supply amount of the adhesive 160 is too small, since the contact area of the adhesive section 61 to be formed excessively decreases, it is likely that the bonding strength excessively decreases.

The supply amount of the adhesive 160 can be set to, for example, an amount at which the adhesion area in the adhesive section 61 is about 9 $mm^2$. However, the supply amount of the adhesive is not limited to this. The supply amount can be changed as appropriate according to, for example, the sizes of the recessed section 310 and the projected section 703 and the size and the use (an environment of use) of the light emitting device 101*b*.

Subsequently, the cover 700 is attached to be put over the housing section 301 of the main body section 300. Then, as shown in FIG. 11(*a*), when the projected section 703 is inserted into the inside of the recessed section 310, a predetermined amount of the adhesive 160 flows out from the opening section of the recessed section 310. The flown-out adhesive 160 enters between the surface 309*a* and the end face section 701*b* of the cover 700.

Thereafter, the adhesive section 61 is formed by hardening the adhesive 160. The cover 700 is fixed to the main body section 300 via the adhesive section 61.

The hardening of the adhesive 160 may be performed at, for example, the room temperature or may be performed by heating the adhesive 160 to a predetermined temperature. However, a hardening method for the adhesive 160 is not limited to this and can be changed as appropriate according to the type and the like of the adhesive 160.

If the adhesive section 61 according to this embodiment is provided, it is possible to enjoy action and effects same as the action and effects of the adhesive section 60 explained above.

Further, it is possible to stabilize the position of the adhesive section 61 by providing the recessed section 310. It is possible to increase the adhesion area by providing the recessed section 310.

It is possible to further increase the adhesion area by providing the projected section 703. Therefore, it is possible to further increase the bonding strength. Further, it is possible to reduce an amount of the adhesive 160.

Fifth Embodiment

Figure 12A:
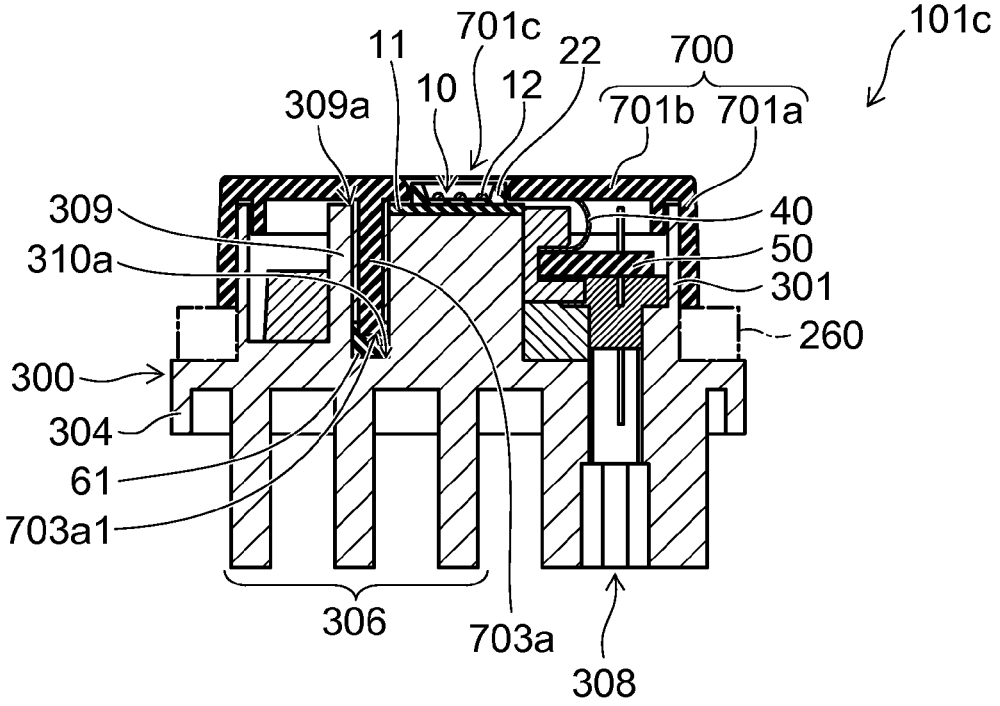
FIGS. 12(*a*) and 12(*b*) are schematic diagrams for illustrating light emitting devices 101*c* and 101*d* according to a fifth embodiment.
Figure 12B:
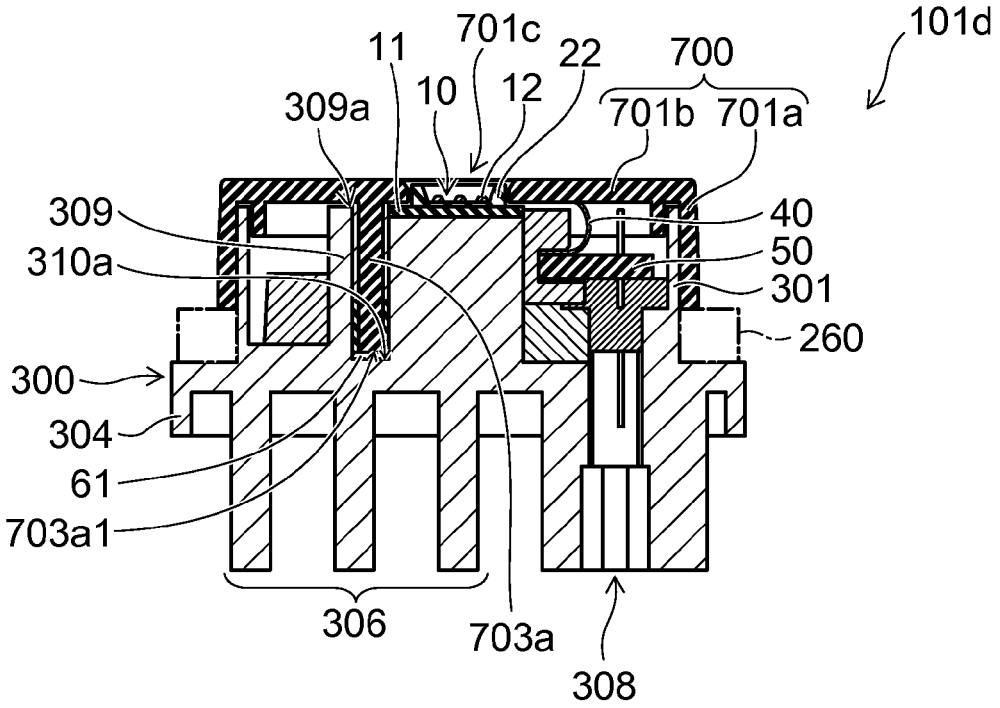
Figure 13A:
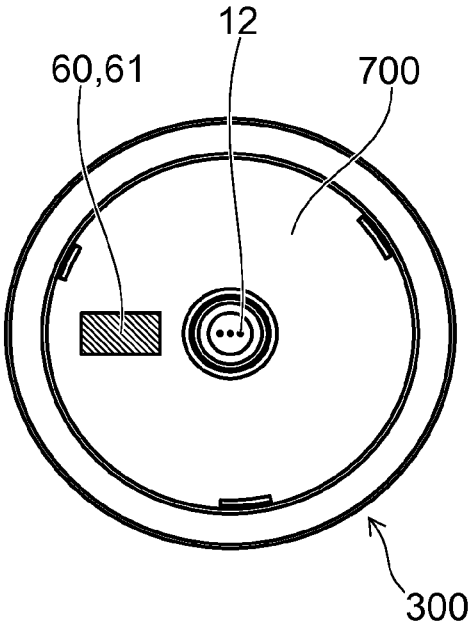
FIGS. 13(*a*) to 13(*d*) are schematic diagrams for illustrating an example of a plane shape of the adhesive sections 60 and 61.
Figure 13B:
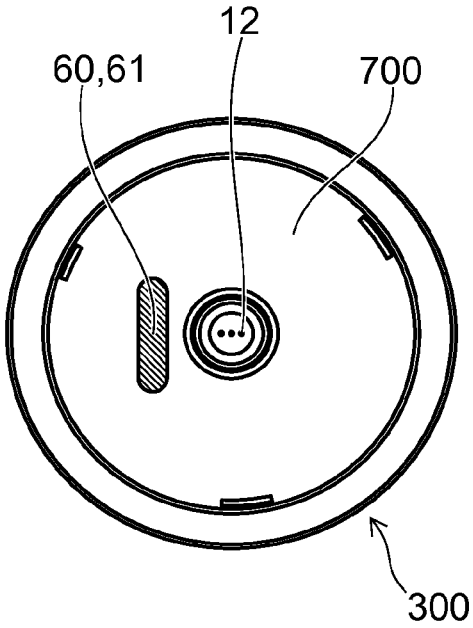
Figure 13C:
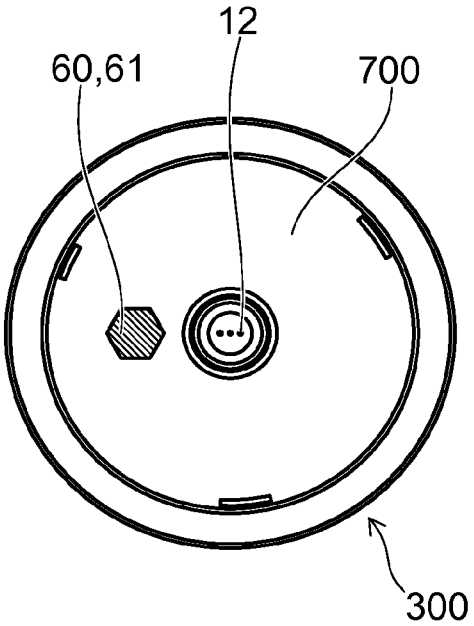
Figure 13D:
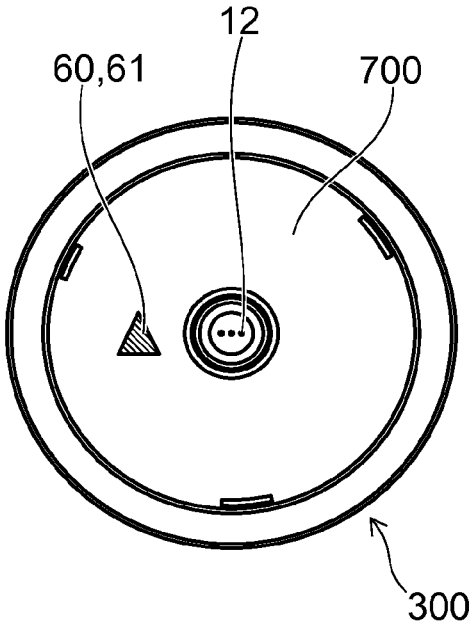

FIGS. 12(*a*) and 12(*b*) are schematic diagrams for illustrating light emitting devices 101*c* and 101*d* according to a fifth embodiment.

As shown in FIGS. 12(*a*) and 12(*b*), a projected section 703*a* is provided in the cover 700 provided in the light emitting devices 101*c* and 101*d*.

In the case of the light emitting device 101*b* illustrated in FIG. 11, the adhesive section 61 is provided in the vicinity of the surface 309*a* of the attaching section 309.

In the case of this embodiment, as shown in FIGS. 12(*a*) and 12(*b*), the adhesive section 61 is provided in a position apart from the surface 309*a* of the attaching section 309. That is, the adhesive section 61 is provided apart from the surface 309*a* of the main body section 300 on which the light emitting section 10 is provided.

In this case, as shown in FIG. 12(*a*), a gap can be provided between a top 703*a*1 of the projected section 703*a* and a bottom surface 310*a* of the recessed section 310.

As shown in FIG. 12(*b*), the top 703*a*1 of the projected section 703*a* and the bottom surface 310*a* of the recessed section 310 can also be set in contact with each other.

According to this embodiment, the distance between the adhesive section 61 and a heat source (the light emitting elements 12) can be increased.

Therefore, since the influence of heat on the adhesive section 61 (thermal deterioration) can be suppressed, it is possible to maintain bonding strength for a long time.

Note that the plane shape of the adhesive sections 60 and 61 explained above is a circular shape. However, the plane shape of the adhesive sections 60 and 61 is not limited to this.

FIG. 13 is a schematic diagram for illustrating an example of the plane shape of the adhesive sections 60 and 61. As shown in FIGS. 13(*a*) to 13(*d*), the plane shape of the adhesive sections 60 and 61 can be regular shapes such as a square shape, an elliptical shape, a hexagonal shape, and a triangular shape. Although not shown in the figure, the adhesive sections 60 and 61 can be adhesive sections having plane shapes formed by any straight lines, curved lines, and the like.

Sixth Embodiment

A light emitting device according to an embodiment of the present invention can be used in various kinds of lighting devices.

In this case, in the lighting devices, lighting and extinction are sometimes repeatedly performed.

Examples of a vehicular lighting device include a front combination light and a rear combination light (stop lamps, tail lamps, turn signals, fog lamps, and the like). In these lights, lighting and extinction are repeatedly performed. Therefore, in a light emitting device used in the vehicular lighting device, the occurrence of the thermal stress explained above is conspicuous.

An environment of use of the vehicular lighting device is −40° C. to 85° C. Therefore, it is likely that thermal stress that occurs in the vehicular lighting device further increases.

In the following explanation, as an example, a vehicular lighting device including the light emitting device according to the embodiment of the present invention is explained.

Figures 14A, 14B:
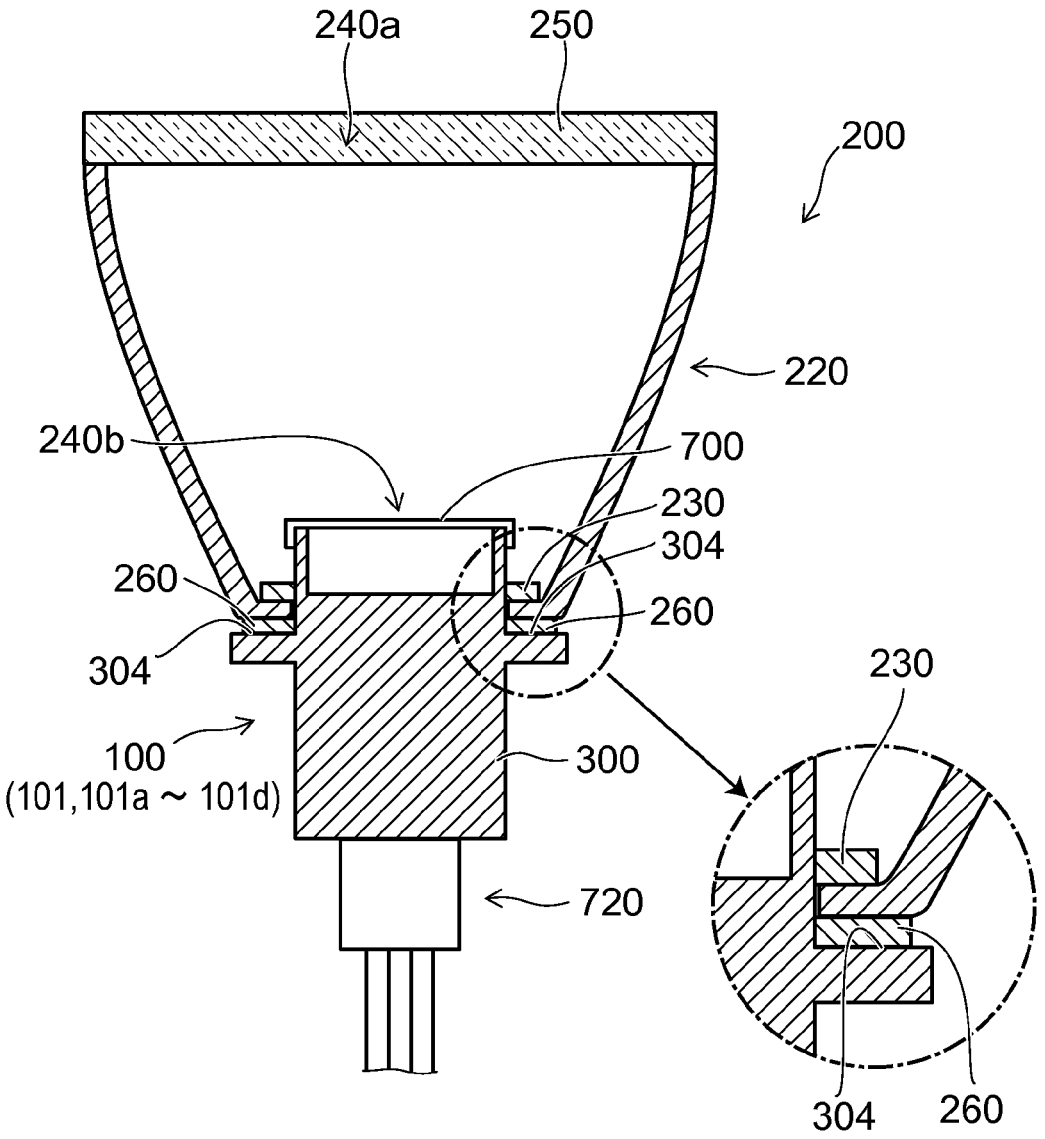
FIGS. 14(*a*) and 14(*b*) are schematic diagrams for illustrating a vehicular lighting device 200 including a light emitting device according to an embodiment of the present invention.

FIG. 14 is a schematic diagram for illustrating a vehicular lighting device 200 including the light emitting device according to the embodiment of the present invention.

Note that FIG. 14(*a*) is a schematic sectional view of the vehicular lighting device 200. FIG. 14(*b*) is a schematic enlarged view of a connecting portion of the light emitting device 100 (101, 101*a* to 101*d*) and the reflector 220.

The vehicular lighting device 200 includes a reflector 220, a lens 250, and the light emitting device 100 (101, 101*a* to 101*d*).

The reflector 220 assumes a substantially truncated cone shape as an external shape and has a space on the inside. The inner surface of the reflector 220 is formed as an inclined surface and reflects light irradiated from the light emitting device 100 (101, 101*a* to 101*d*).

The lens 250 is provided to close an opening 240*a* having a larger sectional area in the reflector 220.

The light emitting device 100 (101, 101*a* to 101*d*) is provided to close an opening 240*b* having a smaller sectional area in the reflector 220.

Light irradiated from the light emitting device 100 (101, 101*a* to 101*d*) is directly irradiated to the outside via the lens 250 or reflected on the inner surface of the reflector 220 and irradiated to the outside via the lens 250.

The vehicular lighting device 200 can be used in, for example, a front combination light, a rear combination light, and the like of an automobile.

A portion further forward than the flange section 304 formed in the main body 300 of the light emitting device 100 (101, 101*a* to 101*d*) is in a state in which the portion is surrounded by the reflector 220 and the lens 250. In this case, the light emitting device 100 (101, 101*a* to 101*d*) and the reflector 220 can be closely attached to each other to prevent water from intruding into the vehicular lighting device 200. For example, a seal 260 made of a material such as rubber or silicone can be provided between the light emitting device 100 (101, 101*a* to 101*d*) and the reflector 220 according to necessity.

Note that a projected section 230 may be provided in the light emitting device 100 (101, 101*a* to 101*d*) for make the connection of the light emitting device 100 (101, 101*a* to 101*d*) and the vehicular lighting device 200 firmer as shown in FIG. 14(*b*). An opening (not shown in the figure) corresponding to the projected section 230 may be provided in the vehicular lighting device 200. Connecting means (not shown in the figure) formed using an elastic body or the like may be provided in the vehicular lighting device 200. That is, means for making the connection of the light emitting device 100 (101, 101*a* to 101*d*) and the vehicular lighting device 200 firmer can be provided as appropriate.

Several embodiments of the present invention are illustrated above. However, these embodiments are presented as examples and are not intended to limit the scope of the invention. These new embodiments can be implemented in other various forms. Various omissions, substitutions, changes, and the like of the embodiments can be made in a range not departing from the spirit of the invention. These embodiments and modifications thereof are included in the scope and the gist of the invention and included in the inventions described in claims and a scope of equivalents of the inventions. Further, the embodiments can be implemented in combination with one another.

The invention claimed is:

1. A light emitting device comprising:

a main body section;

a light emitting section provided in the main body section and including a light emitting element;

a cover provided on a side of the main body section where the light emitting section is provided; and an adhesive section provided between the main body section and the cover in a part of a region on the side of the main body section where the light emitting section is provided, wherein a maximum distance from a center of the light emitting device to an outer edge of the adhesive section is represented as "a" and a distance from the center of the light emitting device to an outer edge of the cover is represented as "b", a following expression is satisfied:

$$a \leq 0.7b.$$

2. The device according to claim 1, wherein a plurality of the adhesive sections are provided.

3. The device according to claim 1, further comprising a recessed section provided at least in one of the main body section and the cover, wherein the adhesive section is provided at least in the recessed section.

4. The device according to claim 1, further comprising:

a recessed section provided at least in one of the main body section and the cover; and a projected section provided in the other of the main body section and the cover and inserted into the recessed section.

5. The device according to claim 4, wherein the adhesive section is provided apart from a surface of the main body section on which the light emitting section is provided.

6. The device according to claim 1, wherein the main body section further includes a fin.

7. A vehicular lighting device comprising the light emitting device according to claim 1.

* * * * *